US010383487B2

(12) United States Patent
Hagleitner

(10) Patent No.: US 10,383,487 B2
(45) Date of Patent: Aug. 20, 2019

(54) SUPPORT BAR AND ROLL ASSEMBLY WITH A CORELESS ROLL AND A SUPPORT BAR

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 353 days.

(21) Appl. No.: 15/359,693

(22) Filed: Nov. 23, 2016

(65) Prior Publication Data

US 2017/0071421 A1 Mar. 16, 2017

Related U.S. Application Data

(63) Continuation of application No. PCT/AT2015/050113, filed on May 7, 2015.

(30) Foreign Application Priority Data

May 23, 2014 (AT) ..... A 400/2014

(51) Int. Cl.

| | |
|---|---|
| ***A47K 10/16*** | (2006.01) |
| ***A47K 10/22*** | (2006.01) |
| ***A47K 10/32*** | (2006.01) |
| ***A47K 10/38*** | (2006.01) |
| ***A47K 10/40*** | (2006.01) |

(52) U.S. Cl.

CPC ..... *A47K 10/38* (2013.01); *A47K 10/16* (2013.01); *A47K 10/22* (2013.01); *A47K 10/40* (2013.01); *A47K 2010/3206* (2013.01)

(58) Field of Classification Search

CPC ..... A47K 10/38; A47K 10/22; A47K 10/16; A47K 10/40; A47K 2010/3206

See application file for complete search history.

(56) References Cited

U.S. PATENT DOCUMENTS

| | | | | |
|---|---|---|---|---|
| 5,370,336 A | | 12/1994 | Whittington | |
| 5,451,013 A | * | 9/1995 | Schutz | A47K 10/3836 242/597.4 |
| 5,495,997 A | * | 3/1996 | Moody | A47K 10/38 242/560 |
| 5,577,686 A | * | 11/1996 | Moody | A47K 10/3836 242/597.4 |
| 5,597,135 A | | 1/1997 | Vandersteene | |

(Continued)

FOREIGN PATENT DOCUMENTS

| | | |
|---|---|---|
| EP | 1411807 B1 | 8/2006 |
| EP | 1646307 B1 | 11/2006 |

(Continued)

*Primary Examiner* — William A. Rivera

(74) *Attorney, Agent, or Firm* — Laurence A. Greenberg; Werner H. Stemer; Ralph E. Locher

(57) ABSTRACT

A support bar has a central region for a material web wound to a coreless roll and a first and a rotatable second bearing journal each projecting beyond the roll. The support bar includes a first and a second part. The first part extends throughout the roll. A first end of the first part forms the first bearing journal. A second part, formed as a rotary body that is rotatable relative to the first part has a second end that forms the second bearing journal. A second end of the first part is formed with an axial bore and a first end of the second part is latched in the axial bore within the roll.

36 Claims, 8 Drawing Sheets

(56) References Cited

U.S. PATENT DOCUMENTS

| | | | | |
|---|---|---|---|---|
| 5,669,576 | A * | 9/1997 | Moody | A47K 10/38 242/560.3 |
| 7,828,240 | B2 | 11/2010 | Hagleitner | |
| D789,111 | S * | 6/2017 | Terrill | D6/523 |
| 9,675,217 | B2 * | 6/2017 | Hagleitner | A47K 10/38 |
| D792,122 | S * | 7/2017 | Hagleitner | D6/523 |
| D830,079 | S * | 10/2018 | Hagleitner | D6/523 |
| 2003/0019971 | A1 | 1/2003 | Lewis et al. | |
| 2006/0236836 | A1 | 10/2006 | Cassia | |
| 2009/0236464 | A1 * | 9/2009 | Cittadino | A47K 10/3836 242/596.7 |
| 2011/0095116 | A1 * | 4/2011 | Hada | B65H 18/28 242/160.1 |
| 2012/0111987 | A1 | 5/2012 | Phelps | |
| 2013/0341456 | A1 * | 12/2013 | Pellengo Gatti | B65H 75/10 242/581 |
| 2014/0353418 | A1 | 12/2014 | Hagleitner | |

FOREIGN PATENT DOCUMENTS

| | | | |
|---|---|---|---|
| EP | 1927308 | A1 | 6/2008 |
| WO | 2010116296 | A2 | 10/2010 |
| WO | 2013123536 | A2 | 8/2013 |

* cited by examiner

SUPPORT BAR AND ROLL ASSEMBLY WITH A CORELESS ROLL AND A SUPPORT BAR

CROSS-REFERENCE TO RELATED APPLICATION

This application is a continuation, under 35 U.S.C. § 120, of copending international application No. PCT/AT2015/050113, filed May 7, 2015, which designated the United States; this application also claims the priority, under 35 U.S.C. § 119, of Austrian patent application No. A 400/2014, filed May 23, 2014; the prior applications are herewith incorporated by reference in their entirety.

BACKGROUND OF THE INVENTION

Field of the Invention

The invention concerns a support bar for a material web that is wound to form a coreless roll, which at at least one end can be provided with a bearing journal that projects beyond the roll and which is rotatable relative to the roll. The invention further pertains to a roll having such a support bar and a dispensing system with a dispenser and at least one roll. The support bar includes at least two parts.

Such a support bar and a dispensing system are disclosed, for example, in my earlier application US 2014/353418 A1 and its counterpart WO 2013/123536. The dispensing system includes a dispenser, the side walls of which have guides for the insertion of a coreless roll of a material web, through which the support bar passes. At least one of the two guides is in the form of a leg and a bearing journal is arranged rotatably at the end of the support bar, that projects out of the roll, the bearing journal at its end having a groove which can be pushed on to the leg. Although the bearing journal cannot rotate on the leg the support bar can rotate with the roll when unrolling the material web, for example household paper, sanitary paper etc from the roll so that it can be wound in a coreless roll and does not require the usual core sleeve.

A further support bar for a paper roll is described in US 2012/0111987. That support bar comprises three parts, wherein a hollow central part passes through the paper roll and has slotted end regions which project therefrom and which are provided with inwardly directed projections. At each side, a bearing journal provided with a cylindrical plug-in portion is pushed into the central part, in which case the projections at the projecting slotted end regions of the central portion bend out and latch into a peripheral groove in the cylindrical plug-in portion of the bearing journal outside the paper roll. Each bearing journal has a guide flange for bearing against the dispenser side wall and therefore in each operation of refilling a paper roll a bearing journal has to be removed in order to be able to push the paper roll on to the central part which is then re-fitted.

SUMMARY OF THE INVENTION

In a further development of the structure of the above-mentioned support bar in accordance with US 2014/353418 A1 and WO 2013/123536 the invention provides for a bearing journal that is provided on a rotary body latched in a bore in the support bar or the first part of the support bar within the roll. Latching the rotary body within the coreless roll makes it possible to use those support bars in dispensers with simple guides in both side walls when two identical bearing journals are used, in dispensers with coded guides when bearing journals corresponding to the coding are used and in dispensers with guide legs or grooves, as the bearing journals, if necessary, can also rotate relative to the support bar; but in addition also in dispensers in which mounting projections are provided at one or both sides, if only one or no bearing journal is required in the support bar as at the location thereof the mounting projections project into the bores in the support bar. Examples of dispensers with mounting projections in the side portions are described in US 2006/236836 A1 and its European counterpart EP 1 646 307, or in US 2003/019971 A1 and its European counterpart EP 1 411 807.

More specifically, there is provided, in accordance with the invention, support bar, comprising:

a first part and a second part;

a central region for a material web wound to form a coreless roll;

the first part extending throughout the roll and having a first end and a second end, the first end of the first part forming a first bearing journal disposed to project beyond the roll;

the second part being a rotary body rotatably mounted relative to the first part and having a first end and a second end, the second end of the second part forming a rotatable, second bearing journal disposed to project beyond the roll; and the second end of the first part being formed with an axial bore and the first end of the second part being latched in the axial bore within the roll.

There is also provided, in accordance with the invention, a roll assembly, which includes a corelessly wound roll of a material web and a support bar as summarized above. The material web, by way of example, is toilet paper or a paper towel web.

In a first preferred configuration the bore in the support bar has an undercut configuration and the rotary body is provided with latching noses which engage behind the undercut configuration. Each rotary body preferably has centrally arranged resilient tongues which are formed or delimited by an opening in the rotary body. In other words, the rotary body has a through opening which is such that, of the full cross-section of the rotary body, only at least two yielding thin regions remain, on which the latching noses are provided. Such a structure makes it difficult to replace a rotary body and therewith the bearing journal.

According to the invention a second configuration provides that the rotary body has an undercut configuration and provided at the first part of the support bar is at least one latching nose which projects into the axial bore and which engages into the undercut configuration.

For coreless rolls it is particularly advantageous if the support bar includes two narrowing parts which can be axially inserted into the roll and which inserted are latched into each other, wherein provided in at least one of the two parts is the axial bore for receiving the rotary body. Each of the two parts can be provided with a flange for delimiting the insertion depth.

By virtue of the rotatability of each rotary body in the support bar the bearing journal projecting from the support bar at the rotary body can be of any desired configuration. Thus, for use in dispensers with coding, the bearing journal can have non-rotationally symmetrical surfaces corresponding to the surfaces of the coding. Those surfaces can be in particular the side surfaces of a groove which is let in on the bearing journal at the end face or a leg provided at the end face on the bearing journal, which co-operate with a rib or a groove respectively at the side wall of the dispenser.

A dispensing system comprising a dispenser for portions to be separated off of a material web wound to form a roll and at least one material web which is wound to form a roll and which is provided non-rotatably on the central region of a support bar, which at each end has a bearing journal projecting out of the roll, wherein provided at at least one of the two bearing journals is a fitting surface which is not in the form of a rotational surface, wherein the dispenser for the at least one bearing journal provided with the fitting surface has a guide which ends in a dispensing position and at the beginning of which there is provided a counterpart surface to the fitting surface of the bearing journal, and wherein insertion of the roll into the dispenser is possible only upon coincidence of the fitting surface and its counterpart surface in the introduction position, is characterized according to the invention in that the at least one bearing journal is arranged on a rotary body rotatably latched in a bore of the support bar and that the counterpart surface on the guide of the dispenser extends into the dispensing position. The guide which extends into the dispensing position is preferably formed by a projecting rib, on to which an end groove in the bearing journal can be pushed.

Other features which are considered as characteristic for the invention are set forth in the appended claims.

Although the invention is illustrated and described herein as embodied in a support bar, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
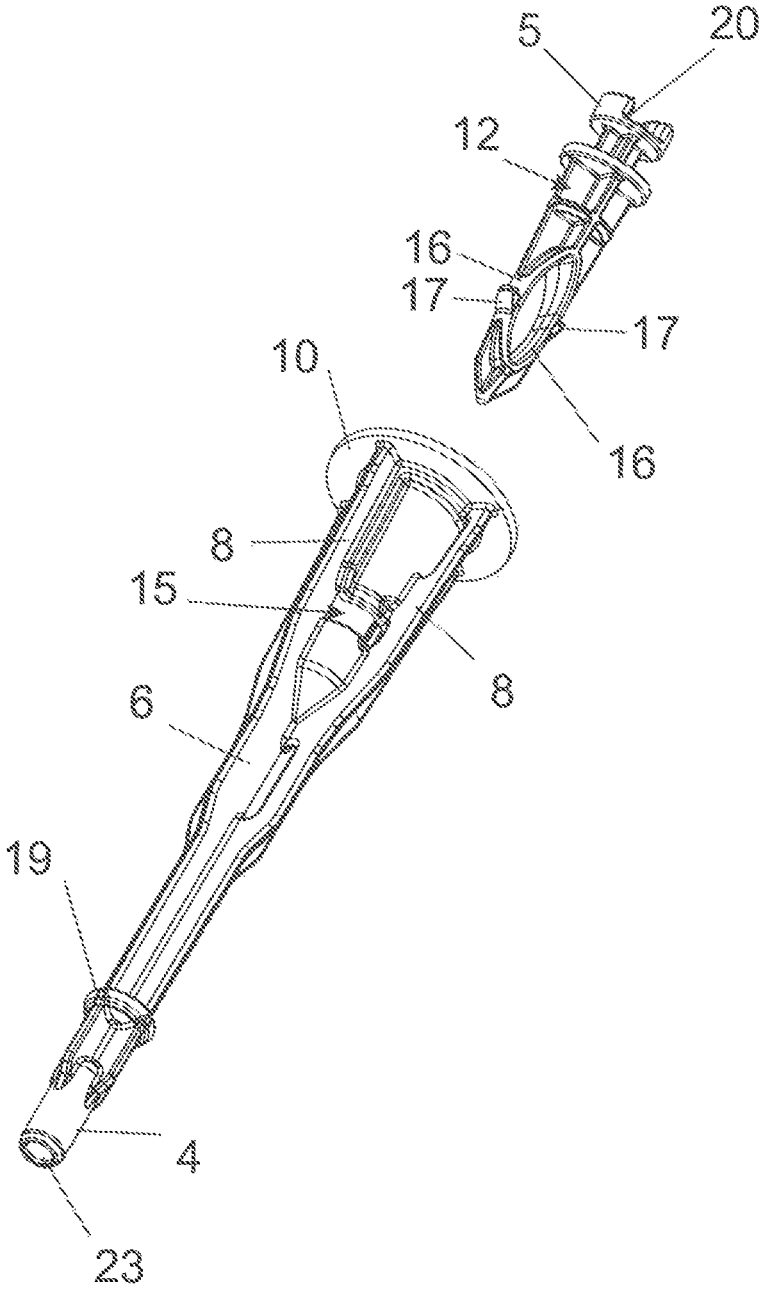
FIG. 1 is a perspective, exploded view of a first exemplary embodiment of a support bar according to the invention with a rotatable bearing journal.

Referring now to the figures of the drawing in detail and first, particularly, to FIG. 1 thereof, there is shown a support bar 1 for a corelessly wound roll 3. The roll 3 is indicated in broken lines in FIGS. 4 through 6. It is, in particular, a paper roll. The support bar 1 has, as shown in FIG. 1, a narrowing portion 6 that can be axially fitted into the roll 3. Bearing journals 4, 5 are preferably provided at the ends on the axis 2 of the roll 3.

The part 6 of the support bar 1 represents a core portion which in FIGS. 1, 2, 3, 5 and 7 embraces the entire length of the roll 3. In FIGS. 4 and 6 the part 6 extends over more than half the roll 3 and is in particular non-releasably latched to a second part 7 which is in the form of a sleeve and which is axially inserted from the other end. Both parts 6, 7 taper towards the respective insertion end and at the other outer end preferably have a respective flange 10, 11 which bears from the outside against the end face of the roll 3 or is slightly pressed into same. The first part 6 has an end bore 14 which is surrounded by the flange 10.

Both parts 6, 7 are provided at the periphery each with between two and six longitudinal ribs 8, 9 which rise towards the flange 10, 11 and which are each of a length of maximum of 40 percent of the support bar 1. The longitudinal ribs 8, 9 extend from the ends approximately equally far into the innermost windings of the roll 3 and provide an approximately well-balanced holding action until used up, which in particular can be felt in the central region 21, as can be seen from FIG. 4, insofar as a free space remains between the innermost winding of the roll 3 and the support bar 1.

Figure 2:
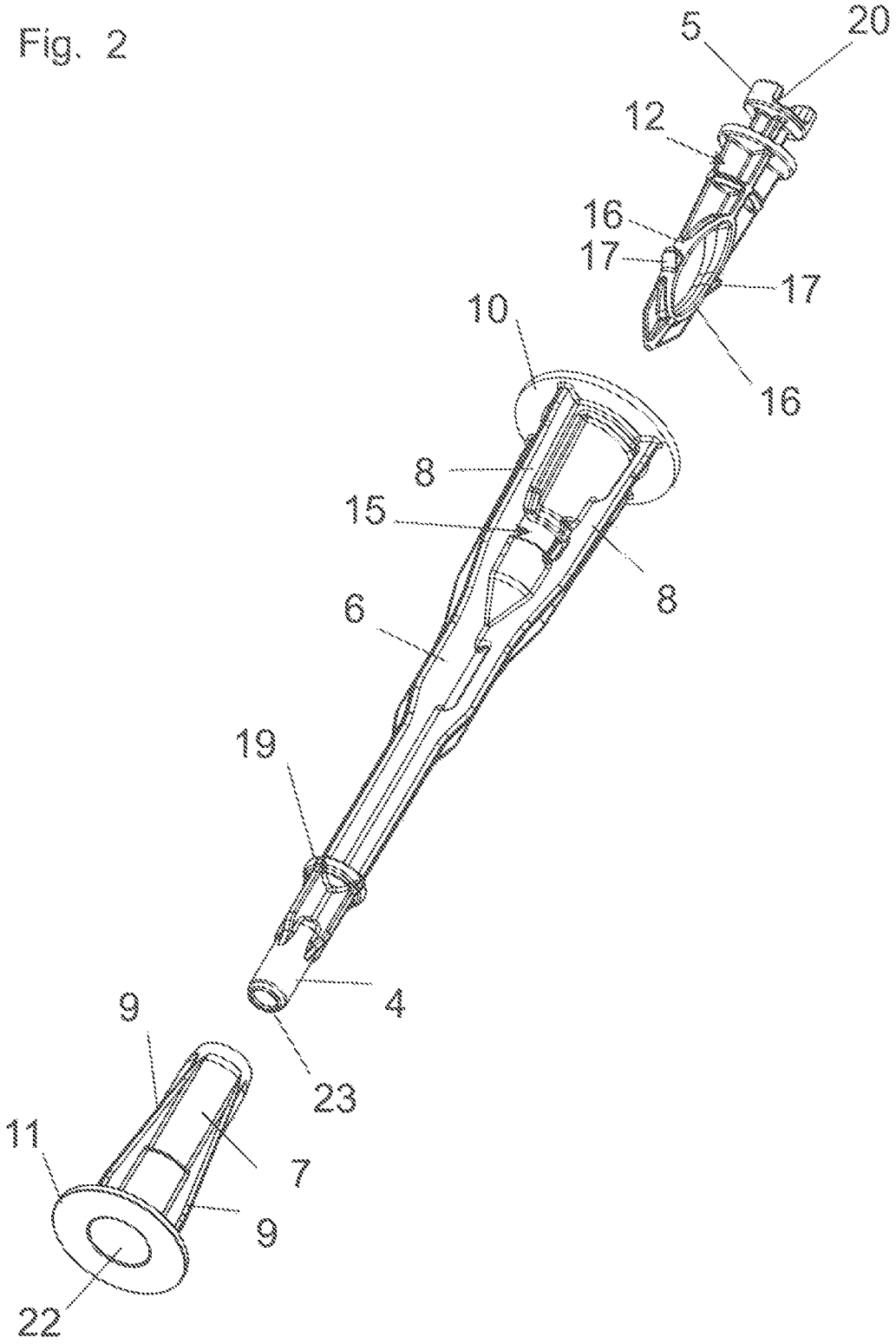
FIG. 2 is a similar view of a second exemplary embodiment of the support bar according to the invention.
Figure 5:
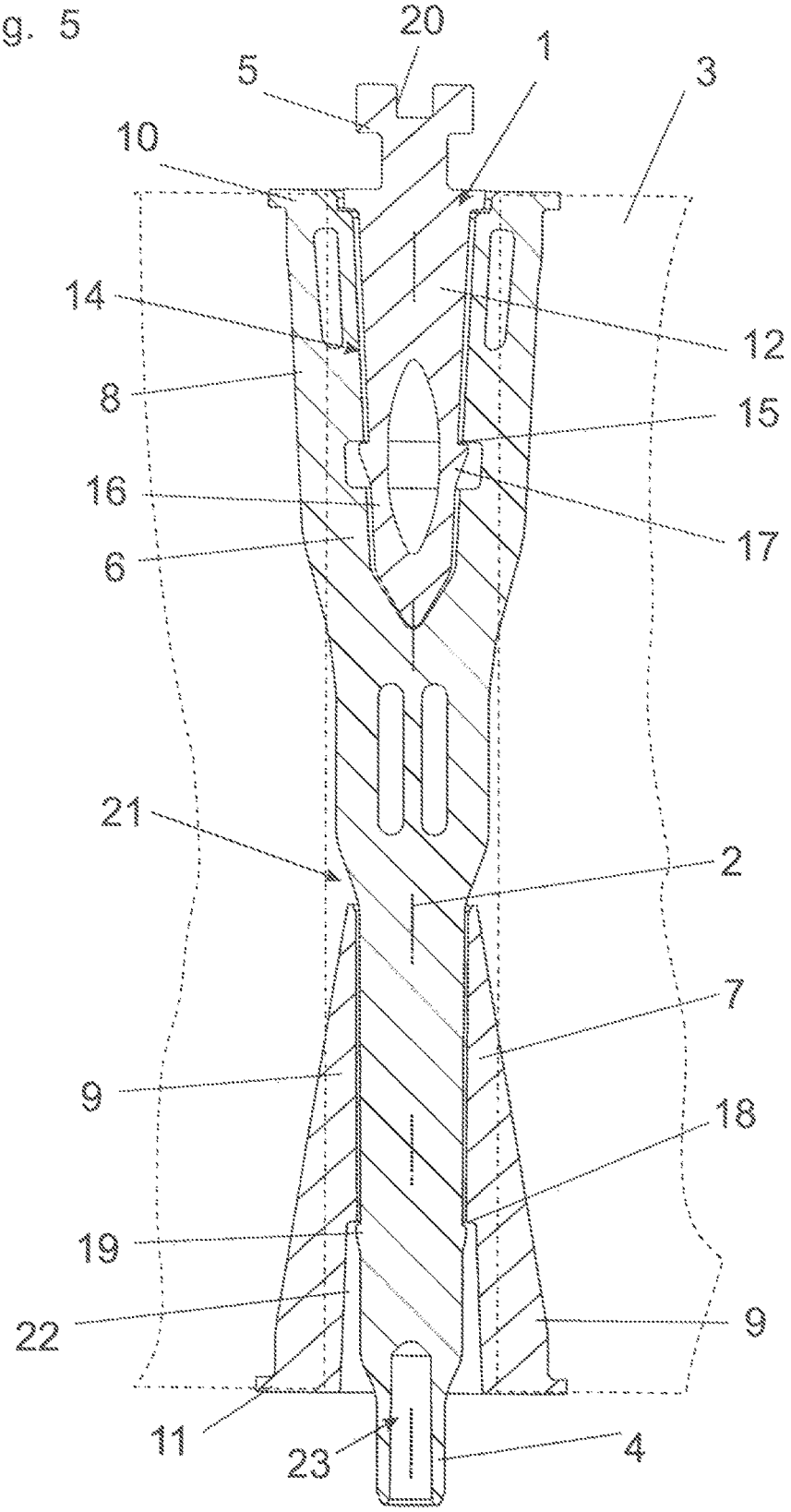
FIG. 5 is a view of a longitudinal section through the embodiment of the support bar of FIG. 2 with an inserted rotatable bearing journal.
Figure 6:
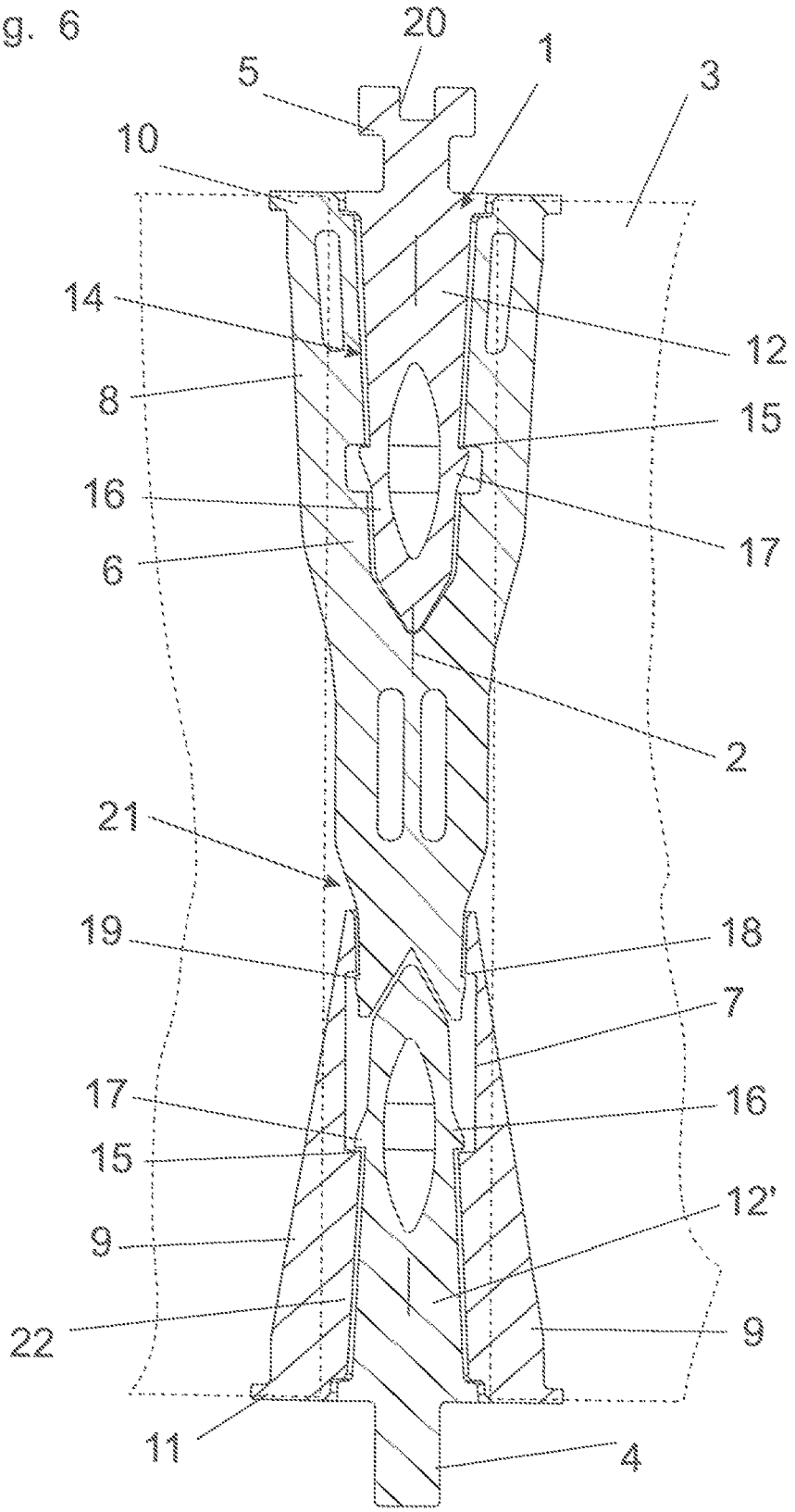
FIG. 6 is a view of a longitudinal section through the embodiment of FIG. 4 with two rotatable bearing journals.

As shown in FIGS. 1, 2 and 5 the insertion end of the first part 6, that faces away from the flange 10, projects beyond the roll 3, wherein that region is of the smallest diameter, and forms a cylindrical bearing journal 4 which can be provided with a bore 23 for receiving an insert, for example a perfume capsule or the like. Provided on the first part 6 at somewhat of an axial spacing from the bearing journal 4 is an annular bead 19 which has an inclined, rising surface and a latching surface disposed approximately perpendicularly to the axis 2 of the support bar 1.

The second part 7 which can be pushed on to the first part 6 as shown in FIGS. 2, 5 and 6 has a bore 22 whose portion which is closer to the flange 11 is of a larger diameter than the portion extending towards the insertion end. The transition between the two bore portions forms an annular shoulder 18 at which the surface of the annular bead 19, that is perpendicular to the axis 2, latches when the second part 7 is fitted on to the first part 6.

A support bar 1 whose insertion end forms a cylindrical bearing journal 4 (FIGS. 1, 2, 3) can be fitted without a second bearing journal 5 into a dispenser if the dispenser has at one side a receiving means and at the other side a mounting projection which engages into the bore 14 in the first part 6. If the dispenser has two mounting projections it is then possible to use the support bar as shown in FIG. 4 without bearing journal, which there, as described, comprises only the two parts 6, 7 which are latched together.

If the dispenser 25 does not have a mounting projection but as shown in FIG. 6 is provided at both sides with guide paths 27, a support bar 1 as shown in FIG. 1 or FIG. 2 which has a bearing journal 4 is fitted with a rotary body 12 provided with a second bearing journal 5. The rotary body 12 is fitted into the bore 14 in the first part 6, in which there is provided an annular groove 15 of an undercut configuration, which is open outwardly between the longitudinal ribs 8. The rotary body 12 is provided h latching noses 17 which latch at the annular groove 15.

The rotary body 12 is apertured or hollow in the region of the latching noses 17 and has at least two resilient tongues 16 which can deflect inwardly when the rotary body 12 is pushed into the bore 14 in the first part 6.

In a second configuration as shown in FIG. 6, if the dispenser 25 does not have a mounting projection, it is also possible to use a support bar 1 as shown in FIG. 4, which in both parts 6, 7 has a respective end bore 14, 22. Here, a respective rotary body 12, 12' carrying a bearing journal is fitted into the two bores and rotatably latched. The rotary body 12' is of the same configuration as the rotary body 12. The bore 22 in the second part 7 has an enlarged central portion so that this forms on the one hand closer to the flange 11 the annular shoulder 15 and on the other hand the annular shoulder 18. The annular bead 19 of the first part 6 in turn latches at the annular shoulder 18 and the latching noses 17 of the rotary body 12' latch at the annular shoulder 15, the latching noses 17 in turn being provided on tongues 16 formed yieldingly by a central hollow space. As can be seen from FIG. 6 rotary bodies 12, 12' with similar or different bearing journals can be fitted into the two bores 14, 22. The rotary body 12' can also be provided with a cylindrical bearing journal 4, similarly to that shown in FIGS. 1 and 2.

Figure 3:
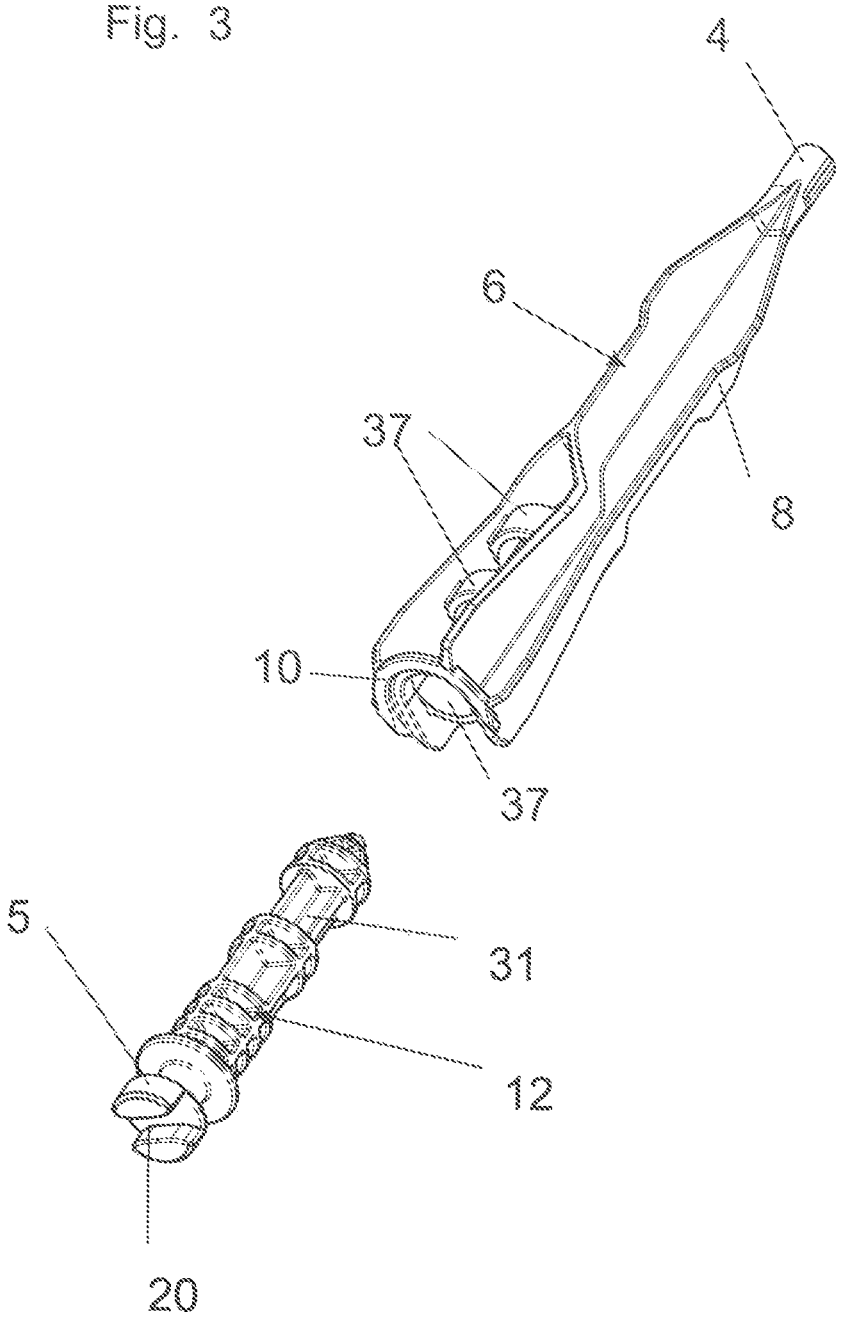
FIG. 3 is a similar view of a third exemplary embodiment of the support bar according to the invention.
Figure 4:
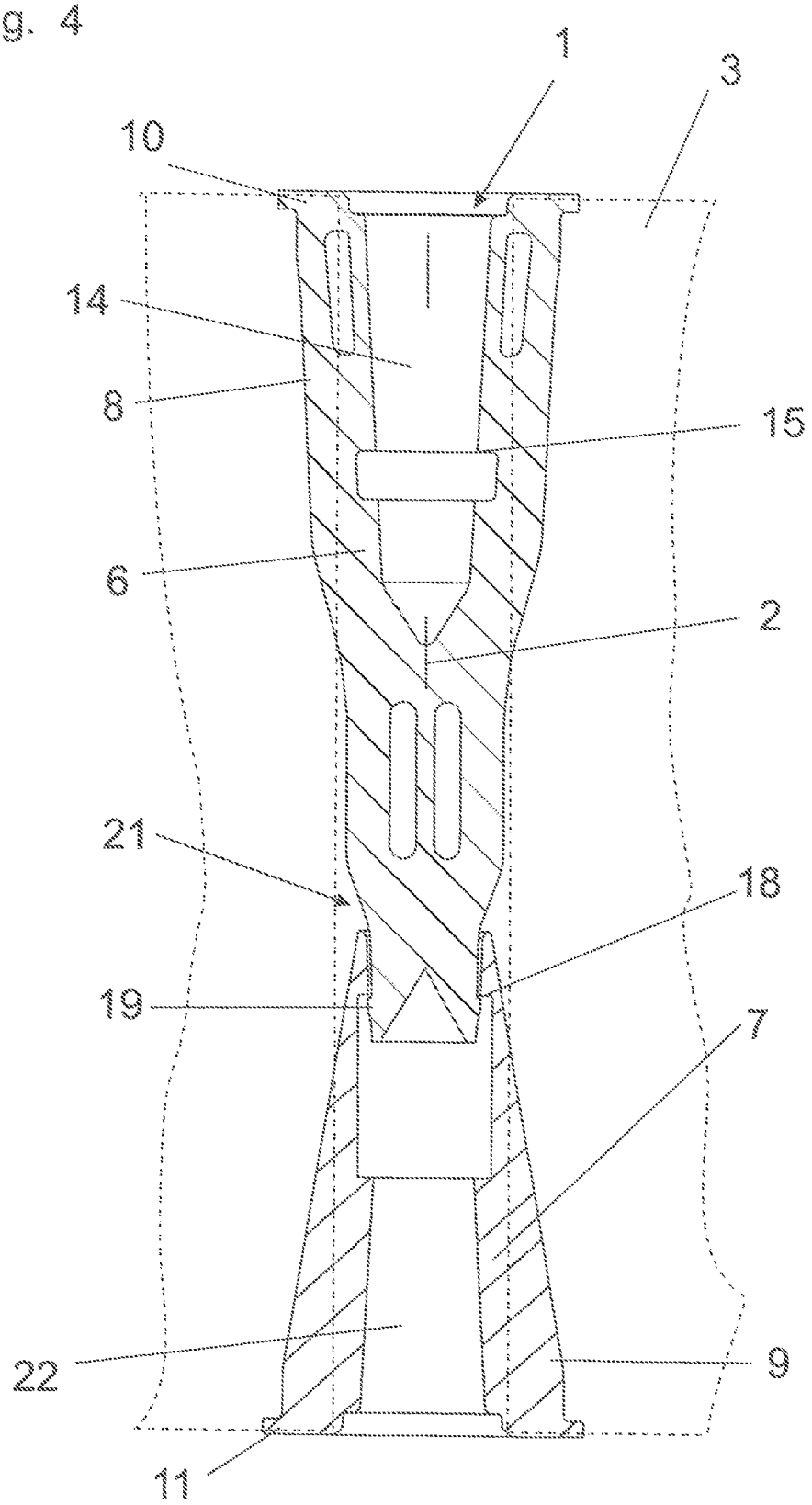
FIG. 4 shows a longitudinal section through an embodiment of a support bar without bearing journal.
Figure 7:
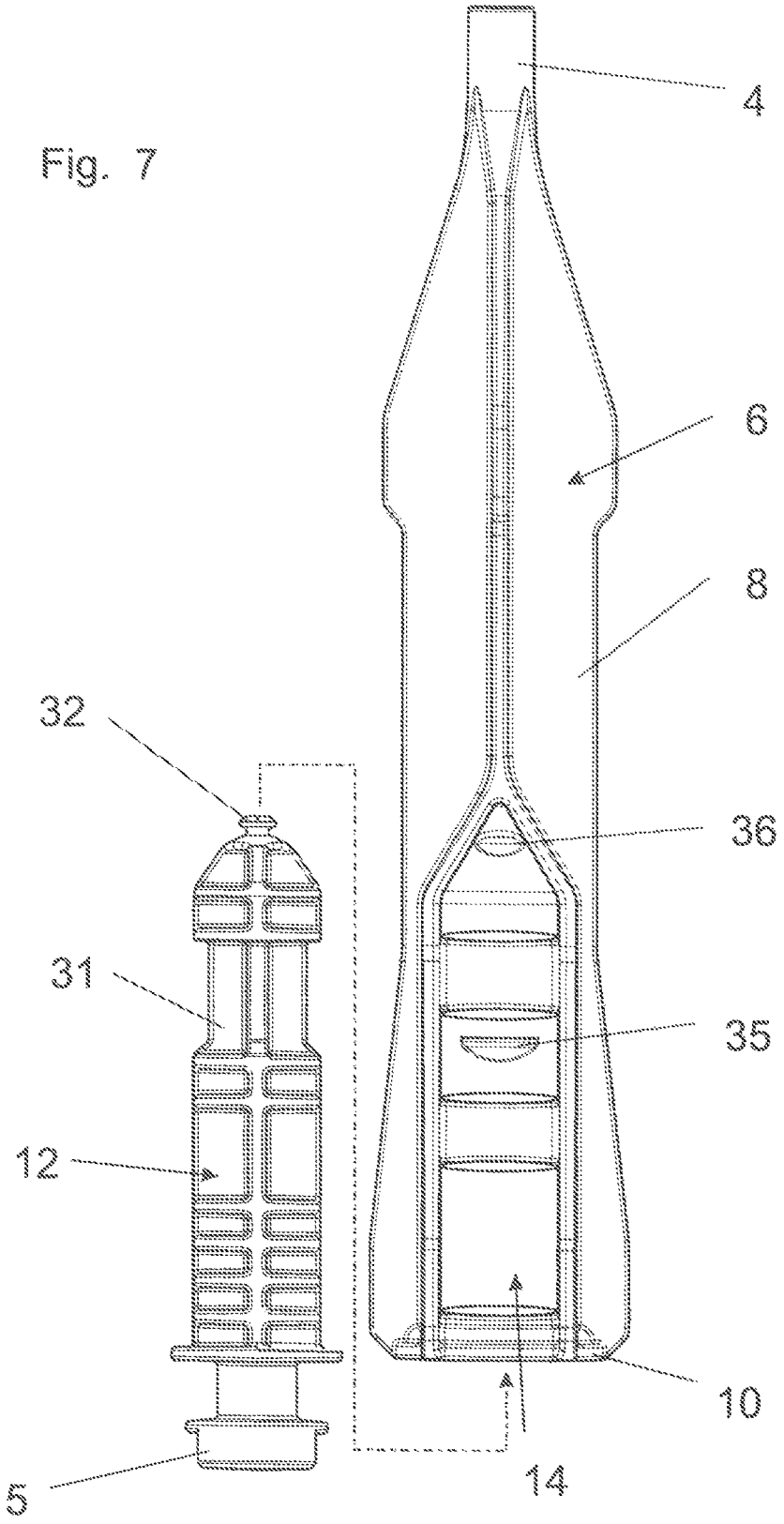
FIG. 7 is a plan view of the two parts of the support bar of FIG. 3.
Figure 8:
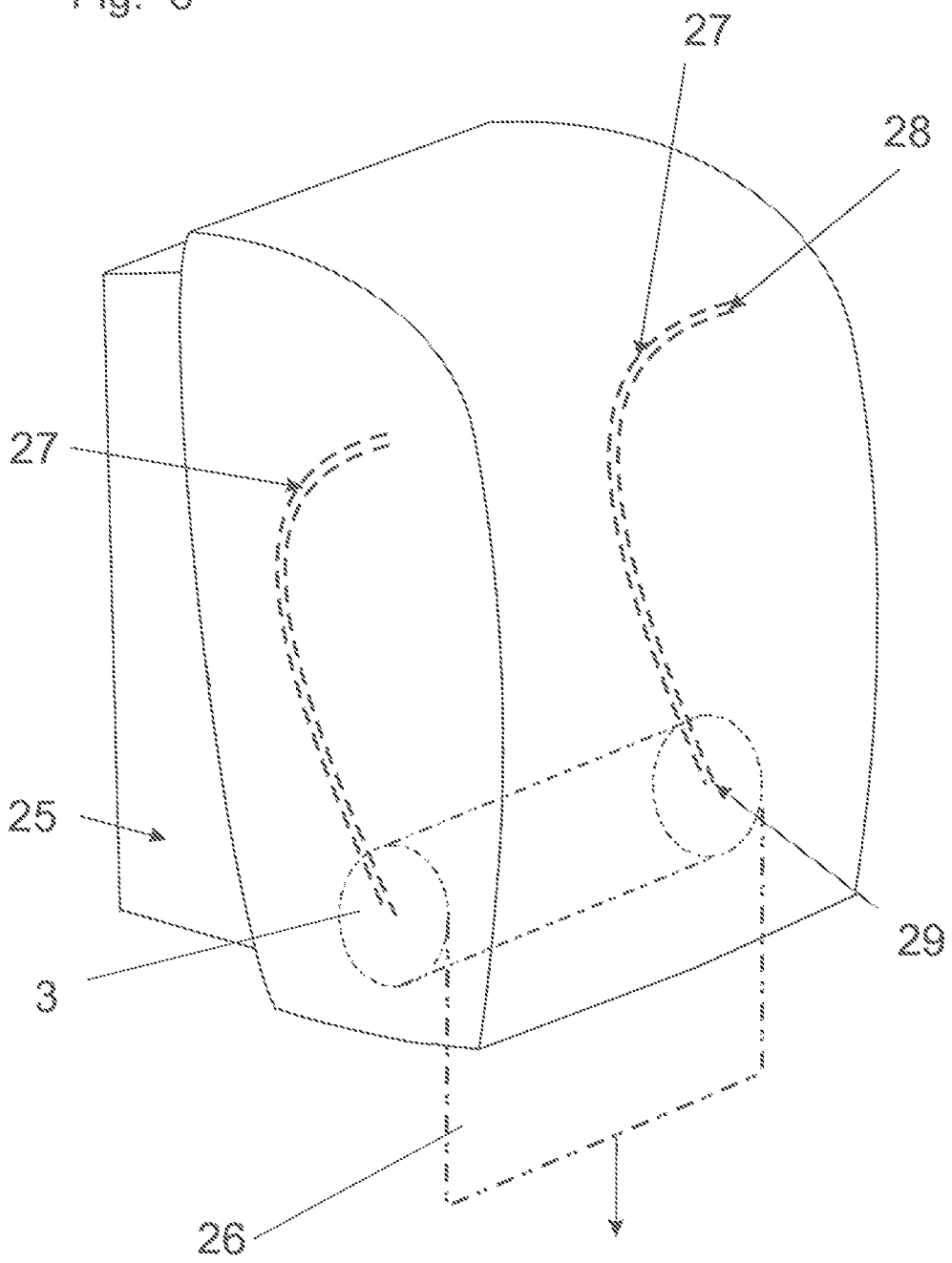
FIG. 8 shows a diagrammatic perspective view of a dispenser for dispensing web material from a roll.

The support bar shown in FIGS. 3 and 7 has a peripheral groove 31 in the rotary body 12 and a mushroom-shaped knob 32 at the insertion tip each defining an undercut configuration. Latching projections 35, 36 provided at the inside of the bore 14 of the first part can latch at both elements 31, 32. Openings in the region of the bore 14 leave free in the first part 6 displaced material curved portions 37 which have the necessary elasticity for latching engagement of the rotary body 12.

In matching relationship with the rotatable bearing journal 5 with a non-rotational surface, in particular a groove 20, the guide path 27 in the dispenser 25 can be of a similar configuration throughout between the insertion position 28 and the dispensing position 29, for example in the form of a leg or rib, in which case removal of the material web 26 from the dispenser 25 (FIG. 6) is possible without any problem by unrolling the support bar 1 on the rotary body 12.

The invention claimed is:

1. A support bar, comprising:

a first part and a second part;

a central region for a material web wound to form a coreless roll;

said first part extending throughout the roll and having a first end and a second end;

said first end of said first part forming a first bearing journal disposed to project beyond the roll;

said second part being a rotary body rotatably mounted relative to said first part and having a first end and a second end;

said second end of said second part forming a rotatable, second bearing journal disposed to project beyond the roll; and said second end of said first part being formed with an axial bore and said first end of said second part being latched in said axial bore within the roll; and wherein said rotatable second bearing journal is provided with non-rotational surfaces.

2. The support bar according to claim 1, wherein said rotary body has an undercut configuration, and wherein at least one latching nose is provided at said first part, which at least one latching nose projects into said axial bore and engages into said undercut configuration.

3. The support bar according to claim 2, wherein at least one resilient tongue is disposed on said first part and said latching nose is provided on said at least one resilient tongue.

4. The support bar according to claim 1, wherein said axial bore is a blind bore.

5. The support bar according to claim 1, wherein said second end of said first part comprises a flange forming an abutment for defining an insertion depth of said first part.

6. The support bar according to claim 1, wherein said rotatable second bearing journal is formed with a groove, and two side surfaces of said groove form said non-rotational surfaces.

7. The support bar according to claim 1, wherein said rotatable second bearing journal is formed with a diametral leg, and two side surfaces of said diametral leg form said non-rotational surfaces.

8. The support bar according to claim 1, configured to support a coreless roll of toilet paper formed with tear-off perforations.

9. The support bar according to claim 1, configured to support a coreless roll of paper towel paper.

10. A roll assembly, comprising a corelessly wound roll of a material web and a support bar according to claim 1.

11. The roll assembly according to claim 10, wherein the material web is toilet paper formed with tear-off perforations.

12. The roll assembly according to claim 10, wherein the material web is paper towel paper.

13. A support bar, comprising:

a first part and a second part;

a central region for a material web wound to form a coreless roll;

said first part extending throughout the roll and having a first end and a second end;

said first end of said first part forming a first bearing journal disposed to project beyond the roll;

said second part being a rotary body rotatably mounted relative to said first part and having a first end and a second end;

said second end of said second part forming a rotatable, second bearing journal disposed to project beyond the roll; and said second end of said first part being formed with an axial bore and said first end of said second part being latched in said axial bore within the roll;

wherein said rotary body has an undercut configuration, and wherein at least one latching nose is provided at said first part, which at least one latching nose projects into said axial bore and engages into said undercut configuration.

14. The support bar according to claim 13, wherein at least one resilient tongue is disposed on said first part and said latching nose is provided on said at least one resilient tongue.

15. The support bar according to claim 13, wherein said axial bore is a blind bore.

16. The support bar according to claim 13, wherein said second end of said first part comprises a flange forming an abutment for defining an insertion depth of said first part.

17. The support bar according to claim 13, wherein said rotatable second bearing journal is provided with non-rotational surfaces.

18. The support bar according to claim 17, wherein said rotatable second bearing journal is formed with a groove, and two side surfaces of said groove form said non-rotational surfaces.

19. The support bar according to claim 17, wherein said rotatable second bearing journal is formed with a diametral leg, and two side surfaces of said diametral leg form said non-rotational surfaces.

20. The support bar according to claim 13, configured to support a coreless roll of toilet paper formed with tear-off perforations.

21. The support bar according to claim 13, configured to support a coreless roll of paper towel paper.

22. A roll assembly, comprising a corelessly wound roll of a material web and a support bar according to claim 13.

23. The roll assembly according to claim 22, wherein the material web is toilet paper formed with tear-off perforations.

24. The roll assembly according to claim 22, wherein the material web is paper towel paper.

25. A support bar, comprising:

a first part and a second part;

a central region for a material web wound to form a coreless roll;

said first part extending throughout the roll and having a first end and a second end;

said first end of said first part forming a first bearing journal disposed to project beyond the roll;

said second part being a rotary body rotatably mounted relative to said first part and having a first end and a second end;

said second end of said second part forming a rotatable, second bearing journal disposed to project beyond the roll; and said second end of said first part being formed with an axial bore and said first end of said second part being latched in said axial bore within the roll;

wherein said axial bore formed in said first part has an undercut configuration, and said rotary body is formed with at least one latching nose that engages into said undercut configuration;

wherein said rotary body has at least one resilient tongue on which said at least one latching nose is provided; and wherein said rotary body is formed with a through opening which is delimited at mutually opposite sides by two resilient tongues.

26. The support bar according to claim 25, wherein said two resilient tongues together form a forked insertion end of said rotary body.

27. The support bar according to claim 25, wherein said axial bore is a blind bore.

28. The support bar according to claim 25, wherein said second end of said first part comprises a flange forming an abutment for defining an insertion depth of said first part.

29. The support bar according to claim 25, wherein said rotatable second bearing journal is provided with non-rotational surfaces.

30. The support bar according to claim 29, wherein said rotatable second bearing journal is formed with a groove, and two side surfaces of said groove form said non-rotational surfaces.

31. The support bar according to claim 29, wherein said rotatable second bearing journal is formed with a diametral leg, and two side surfaces of said diametral leg form said non-rotational surfaces.

32. The support bar according to claim 25, configured to support a coreless roll of toilet paper formed with tear-off perforations.

33. The support bar according to claim 25, configured to support a coreless roll of paper towel paper.

34. A roll assembly, comprising a corelessly wound roll of a material web and a support bar according to claim 25.

35. The roll assembly according to claim 34, wherein the material web is toilet paper formed with tear-off perforations.

36. The roll assembly according to claim 34, wherein the material web is paper towel paper.

* * * * *